US006283482B1

(12) United States Patent
Coulter

(10) Patent No.: US 6,283,482 B1
(45) Date of Patent: Sep. 4, 2001

(54) BINDING WITH A TOOL-FREE SELECTIVELY ADJUSTABLE LEG SUPPORT MEMBER

(75) Inventor: Ryan Coulter, Stowe, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/206,808

(22) Filed: Dec. 7, 1998

(51) Int. Cl.[7] ..... B62B 9/04

(52) U.S. Cl. ..... 280/14.22; 280/618; 280/613; 280/607

(58) Field of Search ..... 280/14.22, 618, 280/617, 607, 629, 619, 630, 633, 634, 14.24; 36/118.2, 118.7

(56) References Cited

U.S. PATENT DOCUMENTS

| | | | | |
|---|---|---|---|---|
| 4,133,119 | | 1/1979 | Kubelka . | |
| 4,473,235 | | 9/1984 | Burt . | |
| 4,494,939 | | 1/1985 | Calapp et al. . | |
| 4,601,118 | * | 7/1986 | Zanaha | 36/118.2 |
| 4,969,655 | | 11/1990 | Katz . | |
| 4,979,760 | | 12/1990 | Derrah . | |
| 5,261,689 | * | 11/1993 | Carpenter et al. | 280/618 |
| 5,277,635 | | 1/1994 | Gillis . | |
| 5,356,170 | * | 10/1994 | Carpenter et al. | 280/618 |
| 5,363,572 | * | 11/1994 | Marega et al. | 36/118.2 |
| 5,417,443 | | 5/1995 | Blattner et al. . | |
| 5,461,802 | * | 10/1995 | Paris et al. | 36/118.2 |
| 5,470,085 | | 11/1995 | Meibock et al. . | |
| 5,549,310 | | 8/1996 | Meibock et al. . | |
| 5,556,123 | | 9/1996 | Fouriner . | |
| 5,647,146 | | 7/1997 | Gabrielli et al. . | |
| 5,660,410 | | 8/1997 | Alden . | |
| 5,727,797 | * | 3/1998 | Bowles | 280/14.2 |
| 5,906,058 | | 5/1999 | Rench et al. . | |
| 5,971,407 | * | 11/1999 | Zemke et al. | 280/14.2 |
| 6,012,237 | * | 1/2000 | Okajima et al. | 36/118.2 |
| 6,027,136 | * | 2/2000 | Phillips | 280/14.2 |
| 6,155,577 | * | 12/2000 | Okajima | 280/14.2 |

FOREIGN PATENT DOCUMENTS

| | | |
|---|---|---|
| 19800180A1 | 7/1998 | (DE) . |
| 0 307 745 A2 | 3/1989 | (EP) . |
| 0855203A1 | 7/1998 | (EP) . |
| 2736842A1 | 1/1997 | (FR) . |
| WO 93/14835 | 8/1993 | (WO) . |
| WO 97/27773 | 7/1997 | (WO) . |

OTHER PUBLICATIONS

PCT International Search Report for PCT/US 99/29004.
Burton catalog, Custom Freestyle bindings, and Freestyle bindings, pp. 29–30 (undated).

* cited by examiner

*Primary Examiner*—Lanna Mai
*Assistant Examiner*—Hau Phan
(74) *Attorney, Agent, or Firm*—Wolf, Greenfield & Sacks

(57) ABSTRACT

A binding including a tool-free system for adjusting the lateral rotation and forward-lean of a leg support member. The binding includes a baseplate, a leg support member mounted for lateral rotation to the baseplate and a tool-free system coupling the support member and the baseplate. The binding may also include a tool-free forward-lean adjuster for setting the angle of the leg support member relative to the baseplate. Thus, the lateral rotation and forward lean of the leg support member may be quickly adjusted without the use of separate tools.

70 Claims, 3 Drawing Sheets

BINDING WITH A TOOL-FREE SELECTIVELY ADJUSTABLE LEG SUPPORT MEMBER

BACKGROUND OF THE INVENTION

1. Field of the Invention

This invention relates generally to bindings and, more particularly, to bindings with a tool-free selectively adjustable highback.

2. Related Art

Specially configured boards for gliding along a terrain are known, such as snowboards, snow skis, water skis, wake boards, surf boards and the like. For purposes of this patent, "gliding board" will refer generally to any of the foregoing boards as well as to other board-type devices which allow a rider to traverse a surface. For ease of understanding, however, and without limiting the scope of the invention, the inventive binding with a tool-free selectively adjustable highback for a gliding board to which this patent is addressed is discussed below particularly in connection with a snowboard. However, it should be appreciated that the present invention is not limited in this respect, and that the aspects of the present invention described below can be used in association with other types of gliding boards and other boards where a binding is employed to secure a person's feet to a board.

Snowboard binding systems may include an upright leg support member called a "highback" (also referred to as a "lowback" and as a "SKYBACK"). The leg support member acts as a lever that helps transmit forces directly to and from the board, allowing the rider to efficiently control the board through leg movement. For example, flexing one's legs rearward against the leg support member places the board on its heel edge, with a corresponding shift in weight and balance acting through the leg support member to complete a heelside turn. Typically, the leg support member abuts a heel hoop of the baseplate so that forces applied through the boot to the leg support member are transmitted through the baseplate into the board. The leg support member may be mounted on the binding for both pivoting of the leg support member in a heel-to-toe direction to position the leg support member in a desired position (referred to in snowboarding as "forward-lean") and rotation about a vertical axis to maintain the leg support member substantially aligned with the heel-edge of the board for efficient heelside response (referred to in snowboarding as "lateral rotation"). The leg support member often times is connected to the baseplate via a screw and nut assembly. To disconnect or reorient the leg support member, a separate tool, such as a screwdriver, is required to loosen or remove the screw. The screw is then retightened after the leg support member has been reconnected and reoriented.

SUMMARY OF THE INVENTION

The present invention is a binding system including a leg support member having an orientation relative to the binding that may be adjusted through actuation of a tool-free locking system. In one embodiment of the invention, the lateral position or rotation of the leg support member relative to the binding may be adjusted. In another embodiment of the invention, the forward lean, or angle, of the leg support member relative to the binding may be changed by the rider. In a still further embodiment, both the lateral rotation of the leg support member and the forward lean of the leg support member may be selectively controlled by the rider.

The binding includes a baseplate and a leg support member that is mounted for lateral rotation to the baseplate.

A tool-free locking system couples the portion of the leg support member and the baseplate for selectively locking the portion of the leg support member to the baseplate without the use of a separate tool. The leg support member may be connected anywhere along the sidewall, including the heel hoop, the lower portion of the sidewall, or intermediate regions. The tool-free locking system is preferably of the quick-release type. Thus, the lateral position of the leg support member may be quickly adjusted.

In one embodiment, the tool-free locking system may include a cam. The cam has a locked position, wherein the cam causes a substantial compressive force between the leg support member and the baseplate, and an unlocked position, wherein the cam releases the substantial compressive force between the leg support member and the baseplate. The tool-free locking system may include a plate having a bearing surface cooperating with the cam. The plate may be disposed between the cam and the baseplate or the leg support member for distributing the compressive force. Further, a surface of the plate may include a plurality of ridges opposite the bearing surface. Similarly, the leg support member or the baseplate may include a plurality of ridges for matingly engaging the plurality of ridges formed on the surface of the plate.

In another embodiment, the tool-free locking system may be configured as over-center having a locked position which fixedly attaches the leg support member to the baseplate, and an unlocked position, where the leg support member is free to move relative to the baseplate. The system may also have an intermediate position where the system tends to move to one of the locked position or the unlocked position. The system may include an actuator to provide tactile feedback as the system transitions through the intermediate position.

Further features and advantages of the present invention as well as the structure and operation of various embodiments of the present invention are described in detail below with reference to the accompanying drawings.

BRIEF DESCRIPTION OF THE DRAWINGS

The invention will now be described, by way of example, with reference to the accompanying drawings, in which.

DETAILED DESCRIPTION

Figure 1:
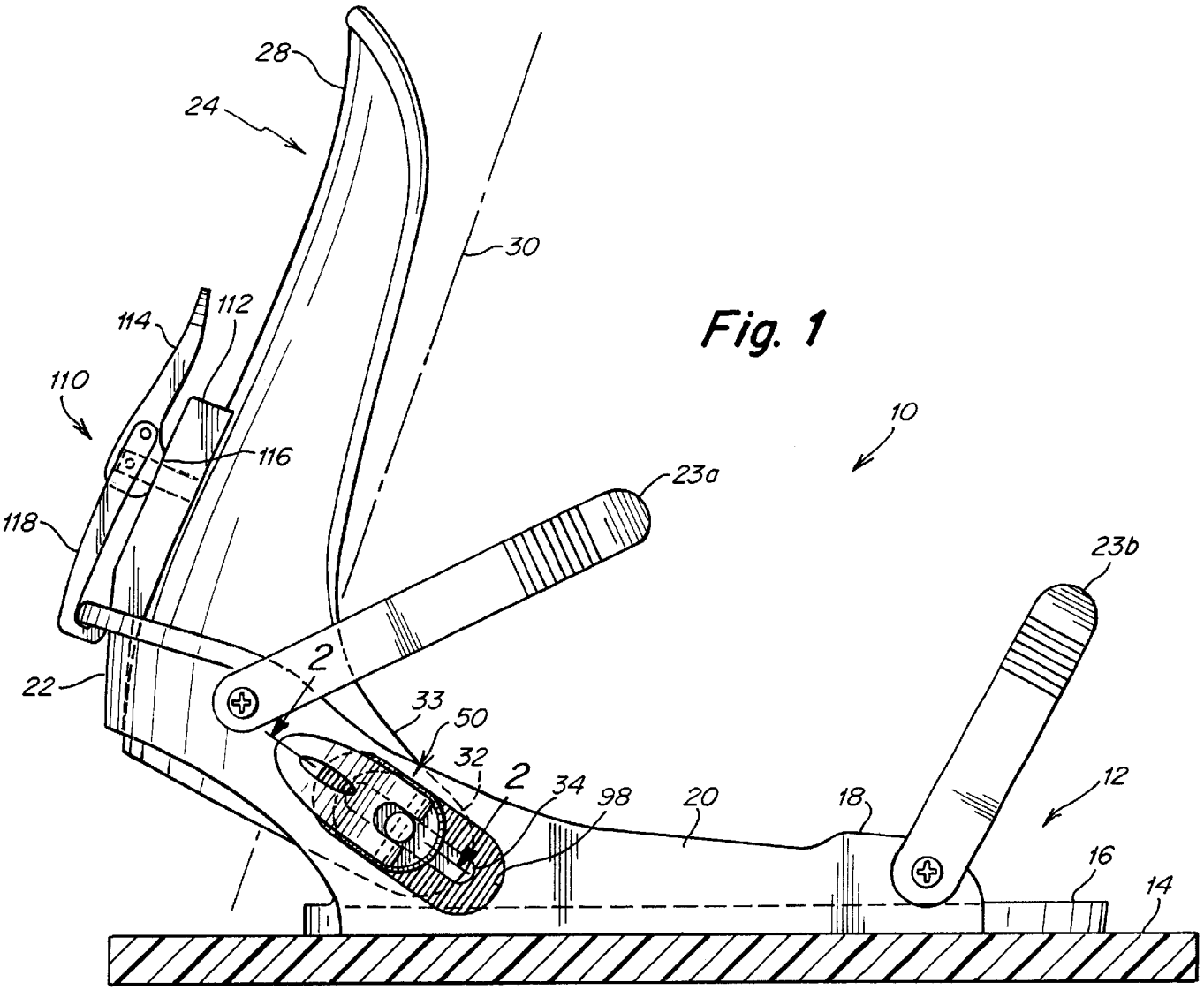
FIG. 1 is a side view of a snowboard binding having a tool-free selectively adjustable leg support member according to the present invention.

A binding of the present invention includes a tool-free system for adjusting the forward lean and the lateral rotation of a leg support member. Although the inventive binding to which this patent is addressed is discussed below particularly in connection with a snowboard, it should be appreciated that the present invention is not limited in this respect, and that the aspects of the present invention described below can be used in association with other types of gliding boards and other boards to which a person's feet are secured by a binding.

The binding 10 includes a baseplate 12 that is mountable to a snowboard 14 such as by a hold-down disc that includes holes for receiving a plurality of screws that may be engaged to fastener inserts in the snowboard 14. The baseplate 12 may include a floor or a bottom wall 16 and a sidewall 18 that extends upwardly therefrom along the lateral sides 20 of the baseplate 12. At the rear (i.e., heel) end of the baseplate 12, the lateral sides 20 of the sidewall 18 may extend rearwardly beyond the end of the bottom wall 16, rising up to merge and form a curved heel hoop 22. The baseplate 12 and sidewall 18 can be formed from a single integrally molded piece. Also, the sidewall 18 may include a single integral wall, or two or more sections joined together, with the sidewall encompassing the lateral sides 20 and the curved heel hoop 22.

One or more binding straps, preferably adjustable straps, may extend across portions of the binding 10 for securing a boot to the snowboard 14. The binding 10 may include an ankle strap 23*a* that extends across the ankle portion of the boot to hold down the rider's heel and a toe strap 23*b* that extends across the binding 10 and holds down the front portion of the boot. Each strap may be attached to opposing lateral sides 20 of the baseplate 12 by a bushing and/or fastener. It is to be understood that the binding 10 may include a single binding strap, such as the ankle strap, or additional straps, such as a shin strap (not shown), and that the straps may be attached to other regions of the baseplate 12. An example of a snowboard binding utilizing straps is described in U.S. Pat. Nos. 5,261,689 and 5,356,170, which are assigned to The Burton Corporation and are incorporated herein by reference.

Alternatively, the binding may be configured as a step-in binding that typically does not employ straps, but rather includes one or more engagement members (not shown) into which the rider can step to lock the boot into the binding. A variety of step-in binding systems are now commercially available.

The binding 10, whether configured with straps or as a step-in binding, includes a leg support member 24 that is mounted to the baseplate 12 to coact with the heel hoop 22 for providing heelside support and heel-edge control. The leg support member 24 includes an upright portion 28 that extends along a vertical axis 30 and that may be adapted to conform to the calf of a rider. The leg support member 24 may include extension arms 32 formed on opposite sides 33 thereof (only one of which is shown in FIG. 1). Although the leg support member 24 shown and described herein includes the extension arms, it is to be appreciated that the extension arms need not be included, or may be shorter or longer than shown in the Figures. The extension arms 32 project forward and terminate near oblong mounting slots 34 formed in the lateral sides 20 of the baseplate 12. It is to be appreciated that, although the mounting slots 34 are shown and described as formed in the lateral sides, the mounting slots 34 may be formed in any suitable location on the baseplate 12, such as the heel hoop 22, or on the leg support member 24, such as the extension arms 32. Also, although an oblong mounting slot is shown and described, a plurality of spaced or overlapping holes may be employed.

The orientation of the leg support member 24 relative to the binding is selectively adjustable through the use of a tool-free locking system. The tool-free locking system includes at least one, and preferably a pair of, tool-free locks for selectively changing the lateral rotation of the leg support member. An additional tool-free lock may be used to adjust the forward lean, as will be described hereinafter. This tool-free system allows for quick positioning of the leg support member relative to the baseplate.

The lateral positioning of the leg support member may be selectively adjusted by the rider to compensate for the stance angle of the baseplate relative to the board. In prior binding systems, the fasteners securing the leg support member to the baseplate, such as a nut and screw, would have to be loosened if not completely disconnected and removed, requiring the use of separate hardware such as a screwdriver and a wrench. In the present invention, however, a tool-free locking system secures the leg support member to the baseplate and may be selectively actuated by the rider to disconnect the two components, allowing the leg support member to be rotated to the desired orientation. The rider then reengages the tool-free locking system, resecuring the leg support member to the baseplate in the new lateral position. Advantageously, the unlocking and reengagement of the leg support and baseplate occurs quickly and without the use of external tools. Preferably, the locking system is fixedly connected to either the baseplate, the leg support member, or to both components, so the locking mechanism is not separated from the binding during repositioning of the leg support member.

An illustrative example of a tool-free locking system for selectively adjusting the lateral position of the leg support member relative to the baseplate of the binding may be a quick-release, cam-actuated lock 50. In the example described herein, two cam-actuated lock and release devices may be provided, one on each side of the binding, although only one is shown in FIG. 1. It should be appreciated, however, that any suitable tool-free lock may be used. Examples of such locks include ball detent locks and spring-loaded pins, to name a few.

Figure 2:
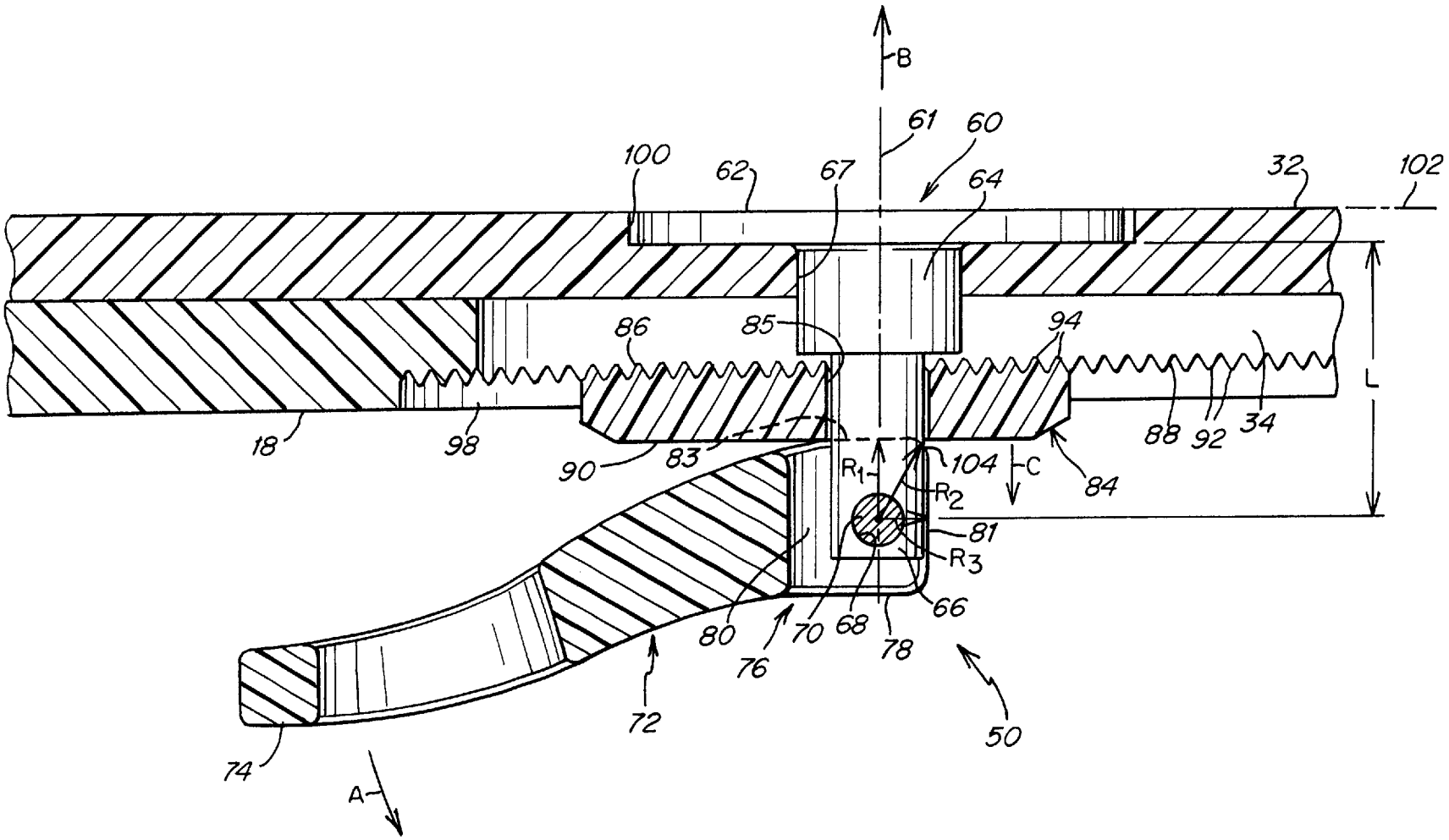
FIG. 2 is a cross-sectional view of a tool-free system suitable for use in the present invention taken along line 2—2 of FIG. 1 shown in a locked position; and, FIG. 3 is a cross-sectional view of the tool-free system shown in an open position.

Referring now to FIG. 2 is a cross-sectional view taken along line 2—2 of FIG. 1 showing the cam-actuated lock 50 in a locked position. The cam-actuated lock 50 includes a plunger 60 defining an axis 61 and having a cap 62, a body 64 extending from cap 62, and a stud 66 extending from the body 64. The body 64 passes through an opening 67 formed in the extension arm 32 and through slot 34. The cap 62 engages the extension arm 32, preferably in mating relation with a compatible recess in the extension arm 32, to prevent axial movement of the plunger 60 relative to the extension arm 32 in a direction toward the outer perimeter of the binding 10.

The stud 66 may include a transverse hole 68 for receiving a pin 70. A lever arm 72, having an extension portion 74 and a yoke portion 76, may be pivotally mounted about pin 70. The yoke portion 76 may include two cam lobes 78 (only one of which is shown) and an opening 80 therebetween. The stud portion 66 extends into the opening 80, thereby allowing the lever arm 72 to pivot about pin 70. Because the lever arm 72 may be attached to the plunger 60 and the plunger 60 may be axially secured relative to the extension arm 32, a self-contained cam-actuated rotator may be provided.

In an illustrative embodiment, each cam lobe 78 includes a dwell surface 81 and a bearing surface 83. In the locked configuration of FIG. 2, the bearing surface 83 presses against the sidewall 18. The plunger 60 may be drawn toward the sidewall 18 and the lever arm 72 in a manner which creates a significant amount of tension on the plunger 60, thereby causing a substantial compressive force between the extension arm 32 and the sidewall 18. The bearing radius "$R_1$", which is defined by the radius between the bearing surface 83 and the center of pin 70, and the distance "L", which is defined by the distance between the intersection of the cap 62 and the body 64 of the plunger 60 and the center of pin 70, are selected to obtain a predetermined amount of tension on the plunger. In a preferred embodiment, the bearing radius "$R_1$" may be about 3.2 mm and the distance "L" may be about 11.55 mm. It should be appreciated that, although the structure and operation of the cam lobe 78 is described in detail relative to the lock 50, the structure and operation of the cam lobe 45 of adjuster 40 may be similar.

Continuing with reference to FIG. 2, the lock 50 may also include an oblong-shaped locking plate 84 having an opening 85 formed therethrough to receive the stud 66. The locking plate 84 includes surface 86 constructed and arranged to mate with the surface 88 of sidewall 18 to distribute the compressive force exerted thereon. The oblong shape of the locking plate 84 further distributes the compressive force, due to the increased surface area, thereby enhancing retention of the leg support member 24 to the sidewall 18, while minimizing stress. The locking plate 84 also includes a bearing surface 90, which is adapted to mate with the bearing surface 83 of lever arm 72. Thus, bearing surface 83 displaces the locking plate 84 away from the bearing surface 83 when in the locked configuration.

To enhance positively locking of the leg support member 24 in its desired position, the surface 88 of the sidewall 14 adjacent the oblong mounting slot 34 may be provided with splines, ribs, or ridges 92. The locking plate 84 may also include complementary splines, ribs, or ridges 94 to matingly engage the splines, ribs, or ridges 92 of surface 88 of sidewall 18.

In an illustrative embodiment, the splines 92 of the sidewall 20 may be formed in a recess 98. This reduces the overall profile of the cam-actuated lock 50. In addition, to limit the extent to which the cap 62 of the plunger assembly 60 protrudes into the area occupied by the boot of a rider, the extension arm 32 may be provided with a recess 100 in which the cap 62 sits. Thus, the cap 62 may lie substantially in the plane 102 of the extension arm 32.

The tool-free lock 50 may be formed in an over-center arrangement wherein a fulcrum 104 is disposed between the dwell surface 81 and a bearing surface 83. To move between a locked configuration and an unlocked configuration, the fulcrum 104 passes through the axis 61 of the plunger 60. In addition, at the point where the fulcrum 104 lies on the axis 61, the lever arm 72 is in an unstable position where it will tend to move into either the locked or unlocked configuration. Thus, once in the locked configuration, the lever arm 72 will tend to remain in the locked configuration. Also, any axial force which tends to pull the plunger 60 away from the lever arm 72 in a direction labeled "B" when the lever arm 72 is in the locked configuration will have the effect of maintaining the lever arm 72 in the locked configuration. The lever arm 72 will tend to remain in the locked position, even under an axial force exerted on the plunger 62, because the fulcrum radius "$R_2$", which is defined as the radius between the center of pin 70 and the fulcrum 104, is greater than the bearing radius "$R_1$". In a preferred embodiment, the fulcrum radius "$R_2$" may be about 3.67 mm.

Figure 3:
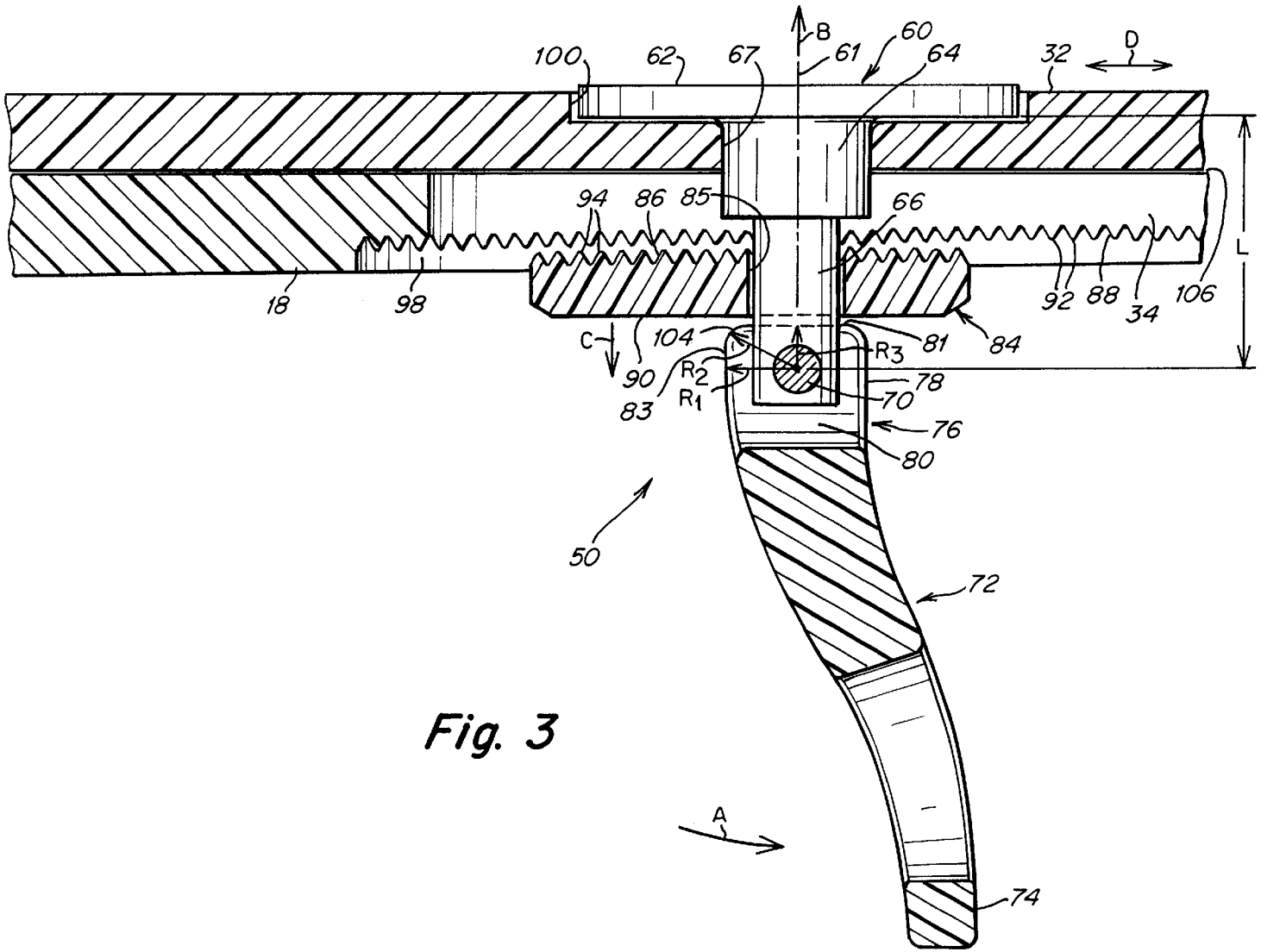

In the unlocked configuration of FIG. 3, which is a cross-sectional representation of the cam-actuated lock and the binding, the lever arm 72 has been rotated in the direction shown as arrow "A". The dwell radius "$R_3$", which is defined by the radius between the center of pin 70 and the dwell surface 81, is less than both the bearing radius "$R_1$" and the fulcrum radius "$R_2$". In a preferred embodiment, the dwell radius "$R_3$" is about 2.5 mm. Thus, when the lever arm 72 is in the configuration shown in FIG. 3, the tension on the plunger 60 has been relieved and is now free to move in a direction shown as arrow "B". Thus, the substantial compressive force between the extension arm 32 and the sidewall 18 is released, thereby allowing the locking plate 84 to move in the direction shown as arrow "C. A small gap 106 may be formed between the extension arm 32 and the sidewall 18, thereby allowing extension arm 32 to move laterally relative to the sidewall 18 in a direction shown as arrow "D".

Because the fulcrum radius "$R_2$" may be greater than the dwell radius "$R_3$", when lever arm 72 is in the unlocked configuration (as shown in FIG. 3), the lever arm 72 will tend to remain in the unlocked configuration. This allows adjustment of the leg support member 24 without the lever arm 72 inadvertently moving into the locked configuration.

Further, the over-center arrangement causes a tactile response when the cam-actuated lock 50 is in the locked position. As the lever arm 72 is rotated into the locked configuration, the resistance felt by the operator tends to increase until the fulcrum 104 is bearing against the sidewall 18 (or the locking plate 84, if provided). Once the fulcrum 104 passes the over-center position (i.e., passes through the axis 61), a further locking movement actually causes the operator to feel a decrease in resistance. Thus, the operator may be assured that the cam-actuated lock 50 is properly locked.

The binding shown in FIG. 1 also includes a tool-free forward-lean adjuster 110, which may be used to set angle of the leg support member 24 to the baseplate 12. The forward-lean adjuster 110 includes an adjustable block 112 that may be slidably attached to the leg support member 24 for quick and convenient forward-lean adjustment. The forward-lean of the leg support member 24 increases as the block 112 is slid in a downward direction from the top of the leg support member toward the bottom of the leg support member. It should be understood, however, that the forward-lean may be adjusted using any suitable adjustment means apparent to one of skill. For example, rather than slidably attaching the block 112 to the leg support member 24, the block 112 and/or the leg support member 24 may include multiple mounting holes that allow selective positioning of the block on the leg support member 24.

An actuator 114 secures the block 112 in the desired position. The actuator 114 may be configured as a tool-free cam-lock handle having a cam lobe 116, which bears against the block for locking engagement with the back of the leg support member. As the actuator is rotated, the cam surface, having a larger radius than a dwell surface 117, forces the block against the leg support member. It is to be appreciated that any other suitable tool-free lock may be used, such as the previously mentioned ball-detent lock or the spring-loaded pin lock. A hook 118 may also be operably attached to the actuator 114 to secure the leg support member 24 to the baseplate 12 for enhanced toe-side response.

While the invention has been described in detail, those skilled in the art to which this invention relates will recognize various alternative embodiments including those mentioned above as defined by the following claims.

What is claimed is:

1. A binding comprising:

a base;

a leg support member mounted to said base;

a forward-lean adjuster cooperating with said leg support member and said base to adjust the forward-lean of said leg support member relative to said base; and at least one tool-free lock for locking said leg support member to said base at at least one mounting location spaced from said forward-lean adjuster, wherein said leg support member includes an opening formed therein and a recess formed around said opening and wherein the base includes a slot formed therein that is aligned with said opening, said at least one tool-free lock comprising:

a plunger having a cap and a stud extending from said cap, said stud passing through said opening formed in said leg support member and through said slot formed in said base, said cap matingly engaging said recess to prevent axial movement of said plunger toward said base; and, a cam cooperating with said plunger to move said plunger between a locked position, wherein said plunger causes a substantial compressive force between said leg support member and said base, and an unlocked position, wherein said plunger releases said substantial compressive force between said leg support member and said base.

2. A binding according to claim 1 wherein said leg support member includes a side portion, and wherein said at least one tool-free lock locks said side portion of said leg support member to said base.

3. A binding according to claim 2 wherein said side portion includes an extension arm, and wherein said at least one tool-free lock locks said extension arm to said base.

4. A binding according to claim 3 wherein said base includes a lateral side, and wherein said at least one tool-free lock locks said extension arm to said lateral side of said base.

5. A binding according to claim 1 wherein said cam has a locked position, wherein said cam also causes said substantial compressive force between said leg support member and said base, and an unlocked position, wherein said cam releases said substantial compressive force between said leg support member and said base.

6. A binding according to claim 5 wherein the at least one tool-free lock includes a bearing plate having a bearing surface cooperating with said cam, with said plate being disposed between said cam and one of said base and said leg support member for distributing said compressive force.

7. A binding according to claim 6 wherein said bearing plate is oblong in shape.

8. A binding according to claim 6 wherein said bearing plate includes a plurality of ridges formed on a surface thereof opposite said bearing surface.

9. A binding according to claim 6 wherein one of said leg support member and said base includes a plurality of ridges formed on a surface thereof for matingly engaging said plurality of ridges formed on said surface of said bearing plate.

10. A binding according to claim 1 wherein said at least one tool-free lock is configured as an over-center lock having a locked position, wherein said leg support member is locked to said base; an unlocked position, wherein said leg support member is free to move relative to said base; and, an intermediate position, wherein said at least one tool-free lock tends to move to one of the locked position and the unlocked position.

11. A binding according to claim 10 wherein said at least one tool-free lock includes an actuator that provides tactile feedback as said at least one tool-free lock transitions through said intermediate position.

12. A binding according to claim 1 wherein said forward-lean adjuster includes a tool-free forward-lean adjuster for adjusting forward lean of said leg support member relative to said base without the use of a separate tool.

13. A binding according to claim 12, wherein the tool-free forward lean adjuster comprises:

an adjustable body selectively positionable relative to the leg support member so as to set the leg support member at a selected forward-lean angle;

a fastener configured and arranged to secure the adjustable body to the leg support member to prevent movement of the adjustable body relative to the leg support member;

a tool-free actuator coupled to the fastener to allow tool-free actuation of the fastener to selectively tighten or loosen the adjustable body against the leg support member; and a latch pivotally attached to the actuator and having a locking portion constructed and arranged for releasably engaging the base to prevent toe-edge pivoting of the leg support member, the actuator configured and arranged to move the latch between a first position in which the locking portion is engageable with the base and a second position in which the locking portion is disengageable from the base.

14. A binding according to claim 13, wherein the actuator is configured as a tool-free cam-lock handle having a cam lobe configured and arranged to bear against the adjustable body for locking engagement with the leg support member.

15. A binding according to claim 12 wherein the at least one tool-free lock comprises a first tool-free lock positioned on a first side of the binding and a second tool-free lock positioned on a second side of the binding, and wherein the tool-free forward lean adjuster is positioned at a rear of the binding between the first and second sides.

16. A binding according to claim 1 wherein said binding is a snowboard binding.

17. A binding according to claim 1 wherein said forward-lean adjuster is adjustably mounted to said leg support member.

18. A binding according to claim 1 wherein the base includes a baseplate and a heel hoop extending from the baseplate.

19. A binding according to claim 18, wherein the leg support member is mounted to the baseplate and abuts the heel hoop.

20. A binding according to claim 1 wherein said at least one mounting location includes a first and a second mounting location and wherein said at least one tool-free lock includes a first and a second tool-free lock, said first tool-free lock locking said leg support member to said base at said first mounting location and said second tool-free lock locking said leg support member to said base at said second mounting location.

21. A binding according to claims 1 wherein said binding is configured as a strap binding.

22. A binding according to claim 1 wherein said binding is configured as a step-in binding.

23. A binding according to claim 1 further comprising a hold-down disc adapted to mount the base to a snowboard.

24. A binding according to claim 1 wherein the leg support member is mounted to the base for lateral rotation relative thereto.

25. A binding comprising:

a base;

a leg support member mounted to said base;

a forward-lean adjuster cooperating with said leg support member and said base to adjust the forward-lean of said leg support member relative to said base; and at least one tool-free lock for locking said leg support member to said base at at least one mounting location spaced from said forward-lean adjuster, wherein said at least one mounting location includes a first and a second mounting location and wherein said at least one tool-free lock includes a first and a second tool-free lock, said first tool-free lock locking said leg support member to said base at said first mounting location and said second tool-free lock locking said leg support member to said base at said second mounting location.

26. A binding according to claim 25 wherein said leg support member includes a side portion, and wherein said at least one tool-free lock locks said side portion of said leg support member to said base.

27. A binding according to claim 26 wherein said side portion includes an extension arm, and wherein said at least one tool-free lock locks said extension arm to said base.

28. A binding according to claim 27 wherein said base includes a lateral side, and wherein said at least one tool-free lock locks said extension arm to said lateral side of said base.

29. A binding according to claim 25 wherein said at least one tool-free lock includes a cam having a locked position, wherein said cam causes a substantial compressive force between said leg support member and said base, and an unlocked position, wherein said cam releases said substantial compressive force between said leg support member and said base.

30. A binding according to claim 29 wherein the at least one tool-free lock includes a bearing plate having a bearing surface cooperating with said cam, with said plate being disposed between said cam and one of said base and said leg support member for distributing said compressive force.

31. A binding according to claim 30 wherein said bearing plate is oblong in shape.

32. A binding according to claim 30 wherein said bearing plate includes a plurality of ridges formed on a surface thereof opposite said bearing surface.

33. A binding according to claim 30 wherein one of said leg support member and said base includes a plurality of ridges formed on a surface thereof for matingly engaging said plurality of ridges formed on said surface of said bearing plate.

34. A binding according to claim 25 wherein said at least one tool-free lock is configured as an over-center lock having a locked position, wherein said leg support member is locked to said base; an unlocked position, wherein said leg support member is free to move relative to said base; and, an intermediate position, wherein said at least one tool-free lock tends to move to one of the locked position and the unlocked position.

35. A binding according to claim 34 wherein said at least one tool-free lock includes an actuator that provides tactile feedback as said at least one tool-free lock transitions through said intermediate position.

36. A binding according to claim 25 wherein said leg support member includes an opening formed therein and a recess formed around said opening and wherein the base includes a slot formed therein that is aligned with said opening, said at least one tool-free lock comprising:

a plunger having a cap and a stud extending from said cap, said stud passing through said opening formed in said leg support member and through said slot formed in said base, said cap matingly engaging said recess to prevent axial movement of said plunger toward said base; and, a cam cooperating with said plunger to move said plunger between a locked position, wherein said plunger causes a substantial compressive force between said leg support member and said base, and an unlocked position, wherein said plunger releases said substantial compressive force between said leg support member and said base.

37. A binding according to claim 25 wherein said forward-lean adjuster includes a tool-free forward-lean adjuster for adjusting forward lean of said leg support member relative to said base without the use of a separate tool.

38. A binding according to claim 37 wherein the first mounting location is on a first side of the binding and the second mounting location is on a second side of the binding, and wherein the tool-free forward lean adjuster is positioned at a rear of the binding between the first and second sides.

39. A binding according to claim 37 wherein the tool-free forward lean adjuster comprises:

an adjustable body selectively positionable relative to the leg support member so as to set the leg support member at a selected forward-lean angle;

a fastener configured and arranged to secure the adjustable body to the leg support member to prevent movement of the adjustable body relative to the leg support member;

a tool-free actuator coupled to the fastener to allow tool-free actuation of the fastener to selectively tighten or loosen the adjustable body against the leg support member; and a latch pivotally attached to the actuator and having a locking portion constructed and arranged for releasably engaging the base to prevent toe-edge pivoting of the leg support member, the actuator configured and arranged to move the latch between a first position in which the locking portion is engageable with the base and a second position in which the locking portion is disengageable from the base.

40. A binding according to claim 39 wherein the actuator is configured as a tool-free cam-lock handle having a cam lobe configured and arranged to bear against the adjustable body for locking engagement with the leg support member.

41. A binding according to claim 25 wherein said binding is a snowboard binding.

42. A binding according to claim 25 wherein said forward-lean adjuster is adjustably mounted to said leg support member.

43. A binding according to claim 25 wherein the base includes a baseplate and a heel hoop extending from the baseplate.

44. A binding according to claim 43 wherein the leg support member is mounted to the baseplate and abuts the heel hoop.

45. A binding according to claim 25 wherein said binding is configured as a strap binding.

46. A binding according to claim 25 wherein said binding is configured as a step-in binding.

47. A binding according to claim 25 further comprising a hold-down disc adapted to mount the base to a snowboard.

48. A binding according to claim 25 wherein the leg support member is mounted to the base for lateral rotation relative thereto.

49. A binding comprising:

a base;

a leg support member mounted to said base;

a forward-lean adjuster cooperating with said leg support member and said base to adjust the forward-lean of said leg support member relative to said base; and at least one tool-free lock for locking said leg support member to said base at at least one mounting location spaced from said forward-lean adjuster;

wherein said forward-lean adjuster includes a tool-free forward-lean adjuster for adjusting forward lean of said leg support member relative to said base without the use of a separate tool, wherein the at least one tool-free lock comprises a first tool-free lock positioned on a first side of the binding and a second tool-free lock positioned on a second side of the binding, and wherein the tool-free forward lean adjuster is positioned at a rear of the binding between the first and second sides.

50. A binding according to claim 49 wherein said leg support member includes a side portion, and wherein said at least one tool-free lock locks said side portion of said leg support member to said base.

51. A binding according to claim 49 wherein said side portion includes an extension arm, and wherein said at least one tool-free lock locks said extension arm to said base.

52. A binding according to claim 51 wherein said base includes a lateral side, and wherein said at least one tool-free lock locks said extension arm to said lateral side of said base.

53. A binding according to claim 49 wherein said at least one tool-free lock includes a cam having a locked position, wherein said cam causes a substantial compressive force between said leg support member and said base, and an unlocked position, wherein said cam releases said substantial compressive force between said leg support member and said base.

54. A binding according to claim 53 wherein the at least one tool-free lock includes a bearing plate having a bearing surface cooperating with said cam, with said plate being disposed between said cam and one of said base and said leg support member for distributing said compressive force.

55. A binding according to claim 54 wherein said bearing plate is oblong in shape.

56. A binding according to claim 54 wherein said bearing plate includes a plurality of ridges formed on a surface thereof opposite said bearing surface.

57. A binding according to claim 54 Wherein one of said leg support member and said base includes a plurality of ridges formed on a surface thereof for matingly engaging said plurality of ridges formed on said surface of said bearing plate.

58. A binding according to claim 49 wherein said at least one tool-free lock is configured as an over-center lock having a locked position, wherein said leg support member is locked to said base; an unlocked position, wherein said leg support member is free to move relative to said base; and, an intermediate position, wherein said at least one tool-free lock tends to move to one of the locked position and the unlocked position.

59. A binding according to claim 58 wherein said at least one tool-free lock includes an actuator that provides tactile feedback as said at least one tool-free lock transitions through said intermediate position.

60. A binding according to claim 49 wherein said leg support member includes an opening formed therein and a recess formed around said opening and wherein the base includes a slot formed therein that is aligned with said opening, said at least one tool-free lock comprising:

a plunger having a cap and a stud extending from said cap, said stud passing through said opening formed in said leg support member and through said slot formed in said base, said cap matingly engaging said recess to prevent axial movement of said plunger toward said base; and, a cam cooperating with said plunger to move said plunger between a locked position, wherein said plunger causes a substantial compressive force between said leg support member and said base, and an unlocked position, wherein said plunger releases said substantial compressive force between said leg support member and said base.

61. A binding according to claim 49 wherein said binding is a snowboard binding.

62. A binding according to claim 49 wherein said forward-lean adjuster is adjustably mounted to said leg support member.

63. A binding according to claim 49 wherein the tool-free forward lean adjuster comprises:

an adjustable body selectively positionable relative to the leg support member so as to set the leg support member at a selected forward-lean angle;

a fastener configured and arranged to secure the adjustable body to the leg support member to prevent movement of the adjustable body relative to the leg support member;

a tool-free actuator coupled to the fastener to allow tool-free actuation of the fastener to selectively tighten or loosen the adjustable body against the leg support member; and a latch pivotally attached to the actuator and having a locking portion constructed and arranged for releasably engaging the base to prevent toe-edge pivoting of the leg support member, the actuator configured and arranged to move the latch between a first position in which the locking portion is engageable with the base and a second position in which the locking portion is disengageable from the base.

64. A binding according to claim 63 wherein the actuator is configured as a tool-free cam-lock handle having a cam lobe configured and arranged to bear against the adjustable body for locking engagement with the leg support member.

65. A binding according to claim 49 wherein the base includes a baseplate and a heel hoop extending from the baseplate.

66. A binding according to claim 65 wherein the leg support member is mounted to the baseplate and abuts the heel hoop.

67. A binding according to claim 49 wherein said binding is configured as a strap binding.

68. A binding according to claim 49 wherein said binding is configured as a step-in binding.

69. A binding according to claim 49 further comprising a hold-down disc adapted to mount the base to a snowboard.

70. A binding according to claim 49 wherein the leg support member is mounted to the base for lateral rotation relative thereto.

* * * * *